US006000727A

United States Patent [19]

DeRose et al.

[11] Patent Number: 6,000,727

[45] Date of Patent: Dec. 14, 1999

[54] METHOD AND APPARATUS FOR CREATING SECURE DOCUMENTS

[75] Inventors: Sue DeRose; Gordon B. Coppoletti, both of Lake Villa, Ill.

[73] Assignee: Moore Business Forms, Inc., Grand Island, N.Y.

[21] Appl. No.: 08/851,079

[22] Filed: May 5, 1997

Related U.S. Application Data

[62] Division of application No. 08/498,377, Jul. 5, 1995, Pat. No. 5,554,044.

[51] Int. Cl.[6] ..... B42D 15/00; B42D 15/10

[52] U.S. Cl. ..... 283/86; 283/58; 283/94; 283/901; 283/904

[58] Field of Search ..... 283/86, 58, 94, 283/101, 107, 108, 109, 110, 111, 901, 904, 17; 101/31.1, 28, 3.1; D18/15; D19/12; 264/1.31, 293; 359/2; 235/457

[56] References Cited

U.S. PATENT DOCUMENTS

| | | | |
|---|---|---|---|
| 397,975 | 2/1889 | De Redon | 194/244 |
| 2,373,540 | 4/1945 | Carver | 40/2 |
| 3,015,267 | 1/1962 | Dashew | 283/108 |
| 3,855,926 | 12/1974 | Dikoff | 101/3.1 |
| 3,898,358 | 8/1975 | Ryan et al. | 101/32 |
| 3,946,663 | 3/1976 | Engeriser | 101/3 R |
| 4,278,017 | 7/1981 | Conjura | 101/3 SP |
| 4,547,002 | 10/1985 | Colgate, Jr. | 283/91 |
| 4,684,795 | 8/1987 | Colgate, Jr. | 235/457 |
| 4,856,857 | 8/1989 | Takeuchi et al. | 283/86 |
| 4,906,315 | 3/1990 | McGrew | 156/231 |
| 4,921,319 | 5/1990 | Mallik | 283/96 |
| 5,106,125 | 4/1992 | Antes | 283/86 |
| 5,142,383 | 8/1992 | Mallik | 359/2 |
| 5,145,212 | 9/1992 | Mallik | 283/86 |
| 5,153,042 | 10/1992 | Indrelie | 428/41.1 |
| 5,155,604 | 10/1992 | Miekka et al. | 359/2 |
| 5,174,608 | 12/1992 | Benardelli | 283/81 |
| 5,248,544 | 9/1993 | Kaule | 428/195 |
| 5,267,753 | 12/1993 | Chock | 283/54 |
| 5,306,899 | 4/1994 | Marom et al. | 235/382 |
| 5,319,475 | 6/1994 | Cueli | 359/2 |
| 5,396,559 | 3/1995 | McGrew | 281/17 |
| 5,464,690 | 11/1995 | Boswell | 283/86 |
| 5,492,370 | 2/1996 | Chatwin et al. | 283/107 |

*Primary Examiner*—Paul A. Bell
*Attorney, Agent, or Firm*—Nixon & Vanderhye P.C.

[57] ABSTRACT

A copyproof document includes a paper document substrate, a disc having a primarily holographic first face facing away from the substrate and a second face with permanent pressure sensitive adhesive engaging the substrate, and mechanical intertwining between the substrate and disc so that they are substantially inseparable. The mechanical intertwining enables the materials thereof become substantially inseparably intertwined, the permanent adhesive also acting to insure inseparability. Typically the parameter of the disc will be a mechanically intertwined with the substrate while at the center there is little or no mechanical intertwining so that the holographic activity of the first face is not significantly occluded. Unique identifying indicia (e.g. consecutive numbers or bar coding) may also be provided on the disc, and application of the discs to a document may not be practiced without security authorization and access (by key, computer, or the like). Also, the number of discs (and typically their unique identification indicia) may be recorded once applied to documents. The positioning of the discs in place with respect to the substrate and the mechanical intertwining step may be accomplished manually or automatically, the mechanical intertwining typically being accomplished by moving first and second cooperating dies to sandwich a disc and substrate between them. The discs may be fed on a web of release material to the document at an area between the dies, the web passing around a release roller which facilitates release of the discs from the web.

20 Claims, 3 Drawing Sheets

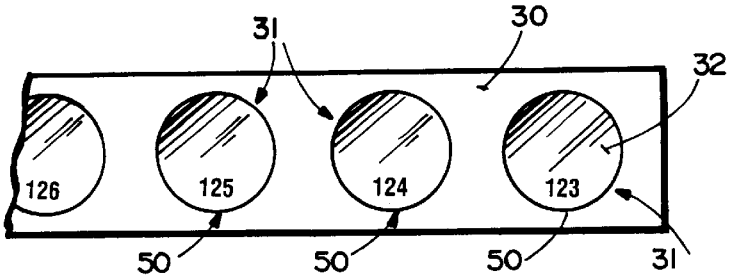
Fig. 2
Fig. 3
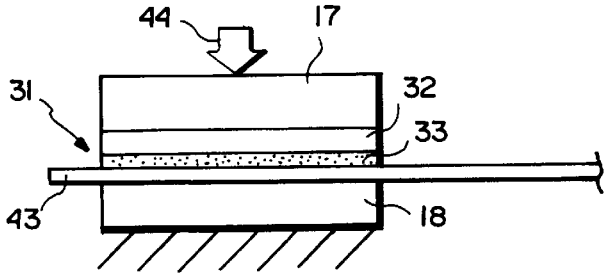
Fig. 4
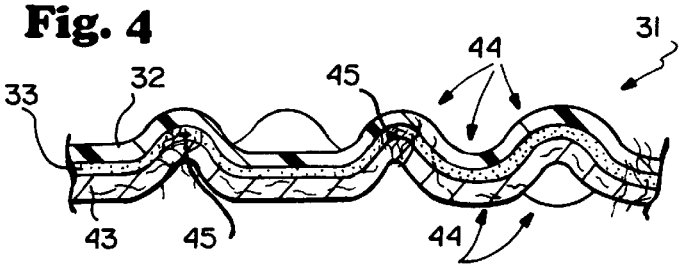
Fig. 6
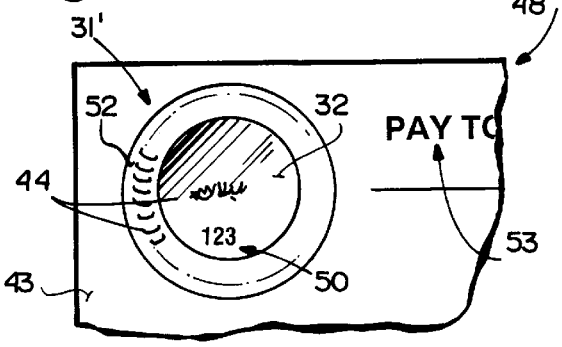
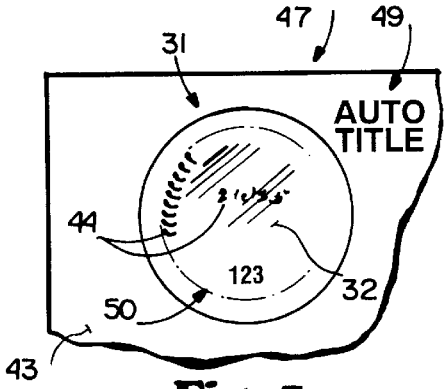
Fig. 5

METHOD AND APPARATUS FOR CREATING SECURE DOCUMENTS

This application is a division of Ser. No. 08/498,377 filed Jul. 5, 1995 now U.S. Pat. No. 5,554,044.

BACKGROUND AND SUMMARY OF THE INVENTION

There is an increasing need for effective methods and mechanisms for making documents (such as gift certificates, titles, checks, transcripts, bonds, etc.) copyproof. One technique which is effective in that regard is the application of holographic material to a document. The holographic material deters duplication utilizing conventional copiers and/or scanners because the multi-dimensional images associated with the holographic material are lost during copying and/or scanning, thus providing a quick check for authenticity. However, clever forgerers are often capable of removing the holographic material from the document to which it is attached. Even when permanent adhesives, which adhere to the underlying substrate so aggressively that tearing of the underlying document and/or hologram is necessary to effective removal, are used they are not completely effective because sometimes they can be removed by acting on the adhesive chemically, or obscured by effectively covering up the holographic material with a masking material.

According to the present invention a method of making a copyproof document, a copyproof document, and a device for making a copyproof document, are provided which have improvements over conventional documents with holograms, such as shown in U.S. Pat. No. 5,145,212. According to the present invention the holographic material is mechanically intertwined when applied to a document substrate so that the materials of the hologram and the substrate become substantially inseparably intertwined. A permanent adhesive is also preferably utilized to even more securely bond the components together. This mechanical intertwining provides a three-dimensional effect, like that of a notarial seal, while at the same time providing the security of a hologram, so that it is much more difficult to copy in a manner that does not clearly indicate a fraudulent secure document (such as checks, bonds, titles, transcripts, certificates, etc.).

According to one aspect of the present invention a method of making a document copyproof is provided. The method comprises the following steps: (a) applying a piece of material, with a primarily holographic face, to a document with the holographic face facing away from the document; and (b) mechanically intertwined the piece of material with primarily holographic face and document so that the materials thereof become substantially inseparably intertwined.

The piece of material with a primarily (preferably completely) holographic face may comprise a disc having a perimeter and a center. Step (b) is typically practiced so as to mechanically intertwine the perimeter of the disc but leave the center primarily or substantially completely unmacerated so as not to occlude the holographic activity thereof. While it is preferred that the disc first face be substantially completely holographic, it may include a perimeter of non-holographic material so that step (b) is practiced to primarily mechanically intertwine the non-holographic perimeter.

As indicated above, the disc preferably includes pressure sensitive permanent adhesive on a bottom face thereof (it is the face opposite the primarily holographic face), step (a) being practiced to apply the adhesive to the document and the adhesive combining with the maceration provided by step (b) to insure that the piece of material with a primarily holographic face and document become substantially inseparable.

Step (b) may be practiced by sandwiching the document and disc between male and female dies, and applying pressure to deform the document and disc to conform to the dies. Step (a) may be further practiced by providing the piece of material on a carrier web and moving the carrier web around a sharp angled turn adjacent the document so that the piece of material releases from the carrier web. There are also preferably the further steps of precluding the practice of step (b) without security authorization and access (e.g. by using a key, combination, or computer control password), and recording the number of pieces of material with a holographic face applied to documents. The pieces of material with holographic faces are preferably uniquely identified (e.g. with serial numbers) and the recording step is further practiced to record the unique identification of each of the pieces of material applied to a document. The moving step may be practiced manually, and step (b) also practiced manually, or the steps can both be practiced automatically.

According to another aspect of the present invention a copyproof document is provided which comprises the following elements: A document substrate (preferably paper). A piece of material having a primarily holographic first face facing away from the document substrate, and a second face engaging the document substrate. And mechanical intertwining between the document substrate and piece of material so that they are substantially inseparable.

The copyproof document according to the invention also preferably further comprises pressure sensitive permanent adhesive between the piece of material second face and the document substrate to further affix them together so that they are substantially inseparable. The piece of material may comprise a disc having a perimeter and a center, and the mechanical intertwining between the disc and the document substrate may be primarily at the disc perimeter so that the holographic activity of the first face is not significantly occluded by the mechanical intertwining. The first face may be substantially completely holographic, and the piece of material may have a unique identifying indicia such as a serial number.

According to yet another aspect of the present invention a mechanical intertivining device is provided comprising the following components: First and second cooperating dies. Means for moving the first die with respect to the second die from a first position in which the dies are spaced from each other a distance greater than the thickness of a piece of material with a primarily holographic first face and a document, to a second position in which they connect by mechanical intertwining a piece of material and document therebetween. A secure access lock for preventing movement of the dies between the first and second positions thereof without secure access. And means for feeding discs of material with a primarily holographic face on a web from a roll to a position between the dies, including a release roller facilitating release of the discs from the web thereat.

The dies that are utilized are preferably of the same type that are used for notarial or corporate seals, being made of metal or other hard material having a complex design and not having interengaging male and female components over the entire surface thereof but rather there being blank portions. The device also may further comprise a counter for counting the number of movements of the dies between the first and second positions thereof, and the moving and feeding means may comprise manual actuators or automatic mechanisms. A common computer control may be provided for controlling the automatic mechanisms, and the computer control may also comprise the secure access lock. For the manual device, a secure access lock may be provided by a key or combination lock. A separate key or combination lock may be provided for gaining access to the supply of holographic discs associated with the dies.

It is the primary object of the present invention to produce and provide an improved copyproof document including holographic material. This and other objects of the invention will become clear from an inspection of the detailed description of the invention and from the appended claims.

BRIEF DESCRIPTION OF THE DRAWINGS

FIG. 2 is a top plan view of the lead end of a web of holographic discs utilized with the apparatus of FIG. 1;

FIG. 3 is a side enlarged schematic view showing the mechanical intertwining force being applied to a holographic disc and a document utilizing the device of FIG. 1;

FIG. 4 is an enlarged schematic cross sectional view showing the mechanical intertwining between a holographic disc and document substrate of the copyproof document according to the invention;

FIG. 5 is a top plan view of a first embodiment of a copyproof document according to the present invention;

FIG. 6 is a top plan view of a modified form of the document of FIG. 5.

DETAILED DESCRIPTION OF THE DRAWINGS

Figure 1:
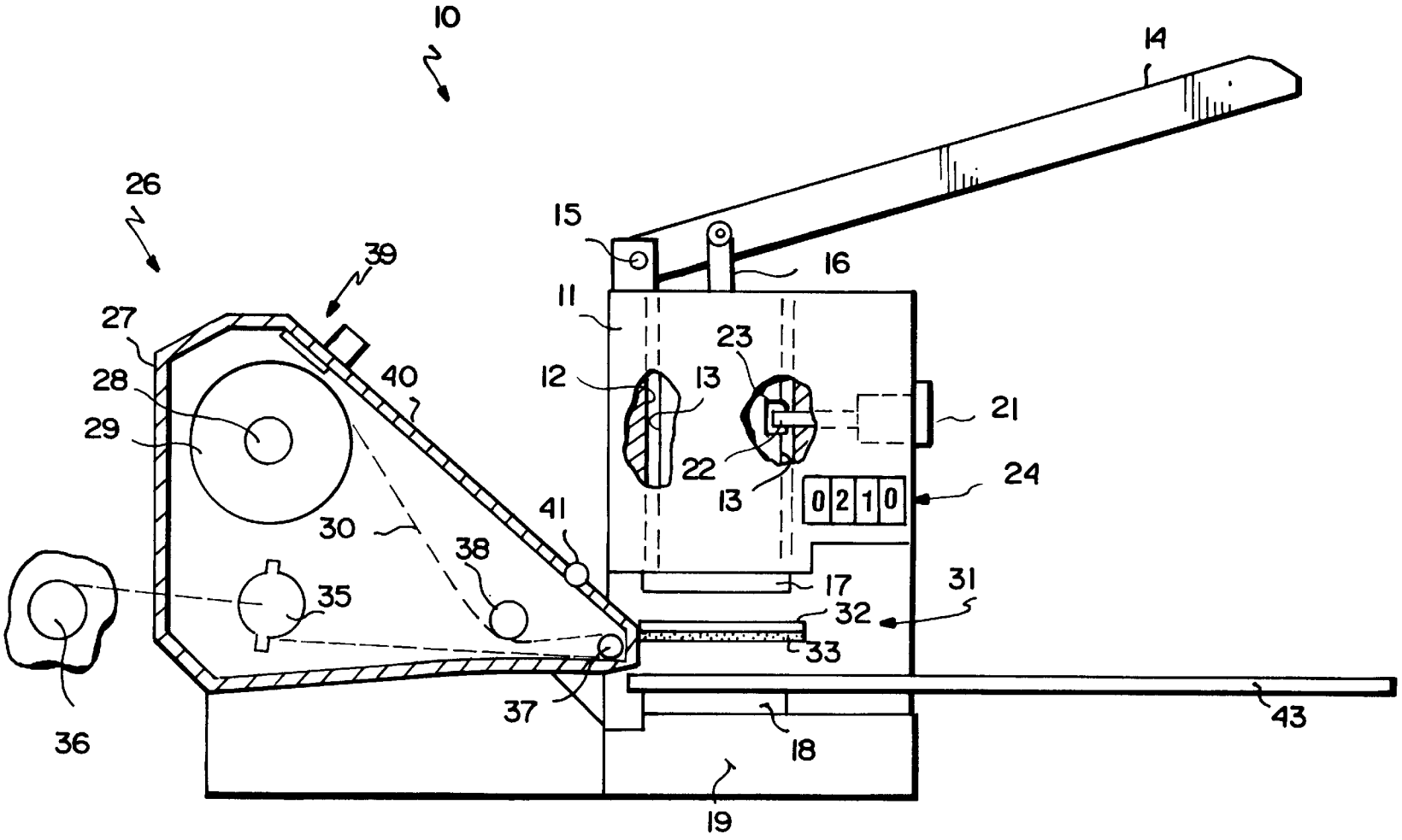
FIG. 1 is a side schematic view, partly in cross section and partly in elevation, of an exemplary manual mechanical intertwining device according to the present invention.

FIG. 1 illustrates an exemplary manual mechanical intertwining device 10 according to the present invention which may be utilized according to the method of the present invention to produce copyproof documents according to the invention. The various components of the device 10 in FIG. 1 are illustrated schematically therein, the exact details of the component not being particularly significant but rather their functional interrelationships and the ultimate functions that they provide being significant.

The device 10 includes a main housing 11 having an internal bore 12 in which a piston 13 is reciprocal. The piston 13 may be reciprocated by a lever 14 or like manual actuator, such as connected at a pivot 15 to an extension of the housing 11, and connected by a plunger or rod 16 to the cylinder 13. Alternatively, in place of the cylinder 13 some sort of linkage may be provided. In any event, at the end of the cylinder or other element 13 opposite the manual actuator 14 is a first die 17, which is adapted to cooperate with a second die 18 mounted on a base 19 of the housing 11.

The dies 17, 18 are preferably conventional male and female mechanical intertwining paper dies (such as used in conventional notarial or corporate seals), for example the female die being the die 17 and the male die the die 18, or vice versa. The movement of the cylinder 13 may only be allowed if a secure access lock—illustrated schematically at 21 in FIG. 1—is deactivated. The secure access lock 21 may be of any conventional type, such as having a blocking projection 22 that is moved into or away from a corresponding slot 23 formed in the cylinder 13, the movement of the plunger 22 being controlled by a key or combination access mechanism. Also, the device 10 preferably includes a counter—shown schematically at 24 in FIG. 1—of any conventional type which counts the number of strokes of the cylinder 13, to thereby count the number of documents which are processed utilizing the device 10.

The device 10 further comprises means for feeding discs of material with a primarily holographic face on a web from a roll to a position between the dies 17, 18. The feeding means are shown generally by reference numeral 26 in FIG. 1, and preferably include a separate housing 27 containing a shaft 28 rotatable about an axis substantially parallel to the pivot axis 15, with a roll 29 of holographic discs provided on a web wrapped around the shaft 28. The web (e.g. of paper) is illustrated schematically at 30 in FIG. 1, and in solid line at 30 in FIG. 2, the web 30 preferably having the matrix material removed therefrom and including a plurality of spaced holographic material discs 31.

In a preferred embodiment each disc 31 has a first (top in FIGS. 1 and 2) surface 32 that is preferably substantially completely, but at least primarily, of holographic material, and a second face opposite the first face, which second face adheres to the web 30. In the preferred embodiment the second face may include a pressure sensitive permanent adhesive 33 (see FIGS. 1 and 3), such as adhesive 9438N available from 3M of Minneapolis, Minn. The adhesive 33 has sufficient agressiveness that it will not separate from the holographic material without destruction of the holographic material.

The adhesive 33 is not in all cases necessary; in some circumstances the disc 31 may be adhered to the web 30 by static electricity, or other readily releasable adherence mechanisms. Where the permanent adhesive 33 is utilized, the face of the web 30 contacting the adhesive 33 is of conventional adhesive-release material (e.g. has a silicone coating).

The holographic material 31 is preferably of conventional type. For example, it may be such as shown in U.S. Pat. No. 5,145,212, or any other conventional type of holographic material, e.g. having some aluminized or other refractive material providing the hologram on a plastic or other material film, and with the permanent adhesive 33 on the bottom of the film.

The feeding mechanism includes the web takeup shaft 35, which—for example—may be rotated by a knob 36 or other manual actuator (e.g. lever) about an axis substantially parallel to the axis of the shaft 28. Various rollers 37, 38, 37, 33 may be provided in the web pathway between the shafts 28, 35, including the release roller 37. The release roller 37 causes the web 30 to pass at a sharp angle thereat (the roller 37 having a small diameter and engaging the bottom face of the web 30, opposite the face having the holographic discs 31 thereon), which causes the holographic disc 31 to thereby move off the web 30 and into position between the dies 17, 18 due to the fact that the housing 27 is mounted in the relative position to the housing 11 illustrated in FIG. 1.

The access to the housing 27 may also be only by key or combination. In the exemplary embodiment of FIG. 1 a conventional key controlled simple lock 39 is illustrated for locking the cover 40 of housing 27 (which is pivotal about the pivot 41) to preclude or allow access to the roll 29 within the housing 27.

In the use of the device 10, as seen most clearly in FIGS. 1 and 3, the dies 17, 18 are moved relative to each other to a position in which a holographic material disc 31 and a document 43 (e.g. typically a secure paper document, such as a title, check, transcript, certificate, bond, or the like) between them with the holographic material face 32 of the disc 31 facing away from the document 43. When a sufficient force 44 (see FIG. 3) is applied (e.g. by pressing down on the lever 14), the dies 17, 18 mechanically intertwine he disc 31 and document 43 so that the materials thereof become substantially inseparably intertwined, for example the paper fibers passing into and through the disc material 31, with the adhesive 33 acting to hold the intertwined fibers even more tightly in place, the mechanical intertwining occurring substantially in the same manner as occurs when a covering sheet of paper is adhered to an underlying sheet by a conventional notarial or corporate seal. FIG. 4 attempts to schematically illustrate a macerating effect showing peaks and valleys of the disc 31 and document 43—the peaks and valleys being illustrated schematically at 44—including individual groups of fibers 45 extending through the disc 31 from the document substrate 43, and vice versa.

FIGS. 5 and 6 show two different forms of copyproof documents 47, 48, respectively, according to the present invention. In FIG. 5 the copyproof document 47 is an auto title having appropriate auto title indicia—illustrated schematically at 49—thereon, with the holographic disc 31 applied as illustrated therein. The mechanical intertwinings between the disc 31 and document substrate 43 provided by the dies 17, 18 are illustrated at 44 in FIG. 5 Note that in this preferred embodiment the mechanical intertwinings are provided primarily around the periphery of the disc 31, with only a few small mechanical intertwinings being provided in the center section of the disc 31. Alternatively, no mechanical intertwinings may be provided in the center of the disc 31. The reason why the primary mechanical intertwinings 44 are provided around the perimeter and not the center is because it is desirable not to occlude the holographic activity of the holographic material surface 32, and if there are too many mechanical intertwinings in the center of the disc 31 holographic activity may be occluded.

FIGS. 2 and 5 also illustrate that discs 31 may have unique identifying indicia associated therewith. For example, see FIG. 2 where the serial numbers 50 are applied, obviously each disc 31 having a different serial number 50 as seen in FIG. 2, and preferably consecutive serial numbers. The unique identifying indicia 50 may be provided by any conventional or effective technique, such as a miniature bar code, machine readable numbers (as in the illustrated embodiment of FIG. 2), microindicia, security threads or the like Typically the indicia 50 will be provided at a portion of the disc 31 that is not mechanically intertwined by the dies 17, 18.

FIG. 6 illustrates another embodiment of copyproof document 48 according to the invention. This embodiment is identical to the previous embodiment except that the disc 31' includes an integral perimeter section 52 (that is integral with the holographic material interior 32) that is not of holographic material so that the macerations 44 primarily take place in the non-holographic material perimeter of the disc 31'. In this particular embodiment the document 48 is a check, and includes the indicia 53. Obviously any type of indicia 49, 53 associated with secure documents may be provided on the substrates 43 (and on the same face thereof as the discs 31, 31').

Figure 7:
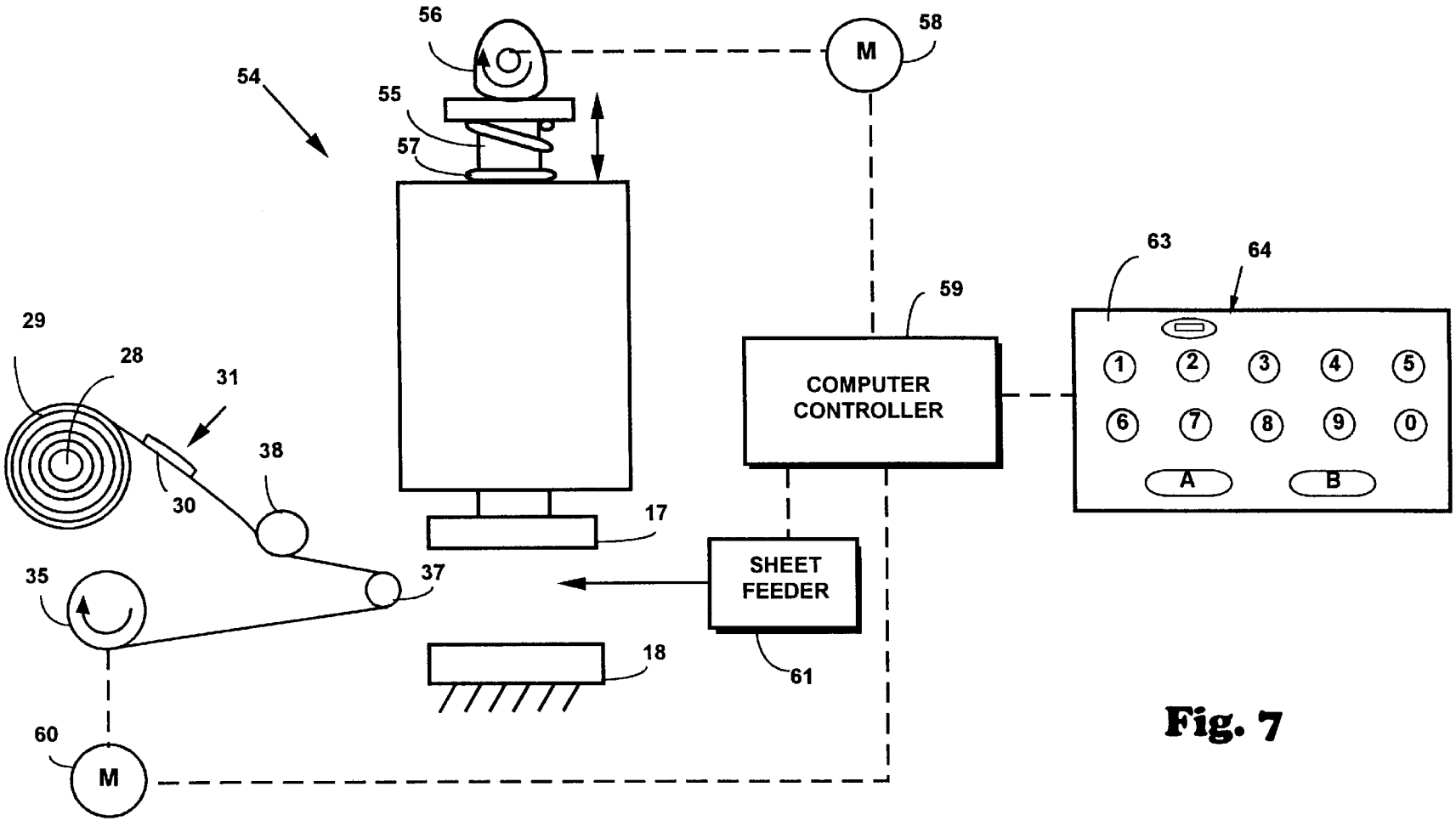
FIG. 7 is a side schematic view showing an automatic mechanical intertwining device embodiment according to the present invention that may be used in place of the manual device of FIG. 1.

FIG. 7 illustrates an automatic device 54 according to the present invention. In this embodiment all of the elements are illustrated schematically, the details thereof not being significant but rather merely their interrelationship and functionality.

The die 17 is shown mounted on a plunger 55 which is operated by a cam 56, and spring pressed by spring 57 into engagement with the periphery of the cam 56. The cam 56 is moved through a single rotation by a stepping motor 58 or the like, under the control of the controller (e.g. computer controller) 59. The shaft 35 is also rotated by a stepper motor 60 to advance the web 30 to advance discs 31 on the web 30 one at a time into the area between the dies 17, 18. The motor 60 is also controlled by the controller 59. Further, a conventional sheet feeding mechanism 61 or the like may also be provided for moving the document 43 into the volume between the dies 17, 18 and then extracting it therefrom, moving it either in a continuous direction, or in a back and forth inserting and withdrawal mode.

The computer controller 59 may be operated by a keyboard 63 or the like, which may require entry of a PIN or other access code or password, before the computer controller 59 will operate the motors 58, 60 and the sheet feeder 61. The computer 59 (which includes a microprocessor) can be programmed to allow operation only between certain hours of specified days of the week by particular operators if high security is necessary. Diagnostic information may also be provided. A key switch—illustrated schematically at 64 in FIG. 7—which must be activated even before access can be gained by operating the computer keyboard 63, may also be provided.

A scanner, opti-mechanical device, or other type of reader may be provided for reading bar coding, or other indicia (e.g. 50), on the discs 31 and operating equipment based upon that reading for sorting or otherwise handling documents 47, 48 produced according to the invention.

It will thus be seen that according to the present invention a method of making a document copyproof, a copyproof document per se, and a mechanical intertwining device for producing copyproof documents, have been provided. Practicing the invention it is possible in a simple, straightforward, yet effective manner to provide copyproof documents.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures, products, and methods.

What is claimed is:

1. A method of making a document copyproof, comprising the steps of:

(a) applying a piece of material comprising a disc having a perimeter and a center, with a primarily holographic face, to a document with the holographic face facing away from the document; and (b) macerating the piece of material with primarily holographic face and document so that the materials thereof become substantially inseparably intertwined by macerating the perimeter of the disc but leaving the center substantially unmacerated so as not to occlude the holographic activity thereof.

2. A method as recited in claim 1 wherein the disc primarily holographic face perimeter is of non-holographic material while the center is of holographic material; and wherein step (b) is practiced to primarily mechanical intertwine the non-holographic perimeter.

3. A method as recited in claim 2 wherein the disc includes pressure sensitive permanent adhesive on a face opposite the primarily holographic face; and wherein step (a) is practiced to apply the adhesive to the document, the adhesive combining with the maceration provided by step (b) to insure that the piece of material with a primarily holographic face and document become substantially inseparable.

4. A method as recited in claim 1 wherein the disc includes pressure sensitive permanent adhesive on a face opposite the primarily holographic face; and wherein step (a) is practiced to apply the adhesive to the document, the adhesive combining with the mechanical intertwining provided by step (b) to insure that the piece of material with a primarily holographic face and document become substantially inseparable.

5. A method as recited in claim 4 comprising the further steps of: precluding the practice of step (b) without security authorization and access, and recording the number of pieces of material with a holographic face applied to documents.

6. A method as recited in claim 5 wherein the pieces of material with a holographic face are uniquely identified, and wherein said recording step is further practiced by recording the unique identification of each of the pieces of material applied to a document.

7. A method as recited in claim 4 wherein step (b) is practiced by sandwiching the document and disc between mate and female dies, and applying pressure to deform the document and disc to conform to the dies.

8. A method as recited in claim 1 wherein step (a) is practiced by providing the piece of material on a carrier web, and moving the carrier web around a sharp angled turn adjacent the document so that the piece of material releases from the carrier web.

9. A method as recited in claim 8 wherein the piece of material is attached to the carrier web with a permanent pressure sensitive adhesive, and wherein the carrier web is a web of adhesive-release material; and wherein step (a) is practiced to apply the adhesive to the document, the adhesive combining with the mechanical intertwining provided by step (b) to insure that piece of material with a primarily holographic face and document become substantially inseparable.

10. A method as recited in claim 9 wherein step (b) is practiced by sandwiching the document and piece of material with primarily holographic face between male and female dies, and applying pressure to deform the documert and piece of material with primarily holographic face to conform to the dies.

11. A method as recited in claim 8 wherein said moving step is practiced manually, and step (b) is also practiced manually.

12. A method as recited in claim 8 wherein said moving step is practiced automatically, and step (b) is also practiced automatically.

13. A method as recited in claim 2 wherein step (b) is practiced by sandwiching the document and piece of material with primarily holographic face between male and female dies, and applying pressure to deform the document and piece of material with primarily holographic face to conform to the dies.

14. A method as recited in claim 2 comprising the further steps of: precluding the practice of step (b) without security authorization and access, and recording the number of pieces of material with a holographic face applied to documents.

15. A method as recited in claim 14 wherein the pieces of material with a holographic face are uniquely identified, and wherein said recording step is further practiced by recording the unique identification of each of the pieces of material applied to a document.

16. A method as recited in claim 1 comprising the further steps of:

precluding the practice of step (b) without security authorization and access, and recording the number of pieces of material with a holographic face applied to documents.

17. A method as recited in claim 16 wherein the pieces of material with a holographic face are uniquely identified, and wherein said recording step is further practiced by recording the unique identification of each of the pieces of material applied to a document.

18. A method as recited in claim 1 wherein step (b) is practiced by sandwiching the document and piece of material with primarily holographic face between male and female dies, and applying pressure to deform the document and piece of material with primarily holographic face to conform to the dies.

19. A method of making a document copyproof, comprising the steps of:

(a) applying each of a plurality of pieces of material, each with a uniquely identified primarily holographic face, to a different document with the holographic face facing away from the document;

(b) macerating the piece of material with primarily holographic face and document so that the materials thereof become substantially inseparably intertwined;

(c) precluding the practice of step (b) without security authorization and access; and (d) recording the number of pieces of material with a holographic face applied to documents by recording the unique identification of each of the pieces of material applied to a document.

20. A method as recited in claim 19 wherein step (b) is practiced by sandwiching the document and piece of material with primarily holographic face between male and female dies, and applying pressure to deform the document and piece of material with primarily holographic face to conform to the dies.

* * * * *

UNITED STATES PATENT AND TRADEMARK OFFICE

CERTIFICATE OF CORRECTION

PATENT NO. : 6,000,727

DATED : December 14, 1999

INVENTOR(S) : DEROSE et al

It is certified that error appears in the above-identified patent and that said Letters Patent is hereby corrected as shown below:

ON THE TITLE PAGE:

Item "[62] Division of application No. 08/498,377, Jul. 5, 1995, Pat. No. 5,554,044."

Is corrected to read

--[62] Division of application No. 08/498,377, Jul. 5, 1995, Pat. No. 5,732,980.--

Signed and Sealed this

Eighth Day of August, 2000

*Attest:*

*Attesting Officer*

Q. TODD DICKINSON

*Director of Patents and Trademarks*